United States Patent [19]

Taylor et al.

[11] 4,356,577

[45] Nov. 2, 1982

[54] MULTIPOSITIONAL MEDICAL BED

[76] Inventors: Gene E. Taylor, 18414 DeBie, Cerritos, Calif. 90701; Donald S. McCulloch, 1655 Clark Ave., Apt. 129, Long Beach, Calif. 90815

[21] Appl. No.: 135,877

[22] Filed: Mar. 31, 1980

[51] Int. Cl.[3] ..... A61G 7/00; A61G 7/10

[52] U.S. Cl. ..... 5/62; 5/60; 5/81 R; 128/33; 248/184; 269/323

[58] Field of Search ..... 5/60, 61, 62, 63, 66–68, 5/81 R; 128/33; 269/323; 248/183, 184

[56] References Cited

U.S. PATENT DOCUMENTS

| | | | |
|---|---|---|---|
| 165,075 | 6/1875 | Wilkin | 5/61 |
| 1,185,054 | 5/1916 | Buckley | 5/61 |
| 1,557,662 | 10/1925 | Crawford | 5/62 |
| 1,573,571 | 2/1926 | Pohl | 5/61 |
| 1,644,043 | 10/1927 | Tiedeman | 5/61 |
| 1,667,982 | 5/1928 | Pearson | 5/61 |
| 1,740,906 | 12/1929 | Rothauszky | 5/61 |
| 2,613,371 | 10/1952 | Keyes, Jr. | 5/61 |
| 3,200,416 | 8/1965 | Warrick | 5/62 |
| 3,219,304 | 11/1965 | Freer | 248/184 X |
| 3,284,815 | 11/1966 | Grossman et al. | 5/61 |
| 3,293,667 | 12/1966 | Ohrberg | 5/62 |
| 3,300,793 | 1/1967 | Thompson | 5/61 |
| 3,302,218 | 2/1967 | Stryker | 5/61 |
| 3,336,606 | 8/1967 | Beitzel | 5/63 |
| 3,434,165 | 3/1969 | Keane | 5/61 |
| 3,603,545 | 9/1971 | Boniface | 248/184 |
| 3,640,520 | 5/1972 | Wieland et al. | 5/62 |
| 3,737,924 | 6/1973 | Davis | 5/61 |
| 3,739,406 | 6/1973 | Koetter | 5/68 |
| 3,752,154 | 8/1973 | Clark | 128/33 |
| 3,827,089 | 8/1974 | Grow | 5/61 |
| 3,832,742 | 9/1974 | Stryker | 5/62 |

*Primary Examiner*—James T. McCall

*Attorney, Agent, or Firm*—Gausewitz, Carr, Rothenberg & Edwards

[57] ABSTRACT

A medical bed is described in which mattresses are mounted in frames which can be rotated about a longitudinal axis and tilted about a transverse axis. The mattresses may be removable and adapted to permit enclosing a patient completely to permit 360° rotation.

2 Claims, 9 Drawing Figures

FIG. 2.
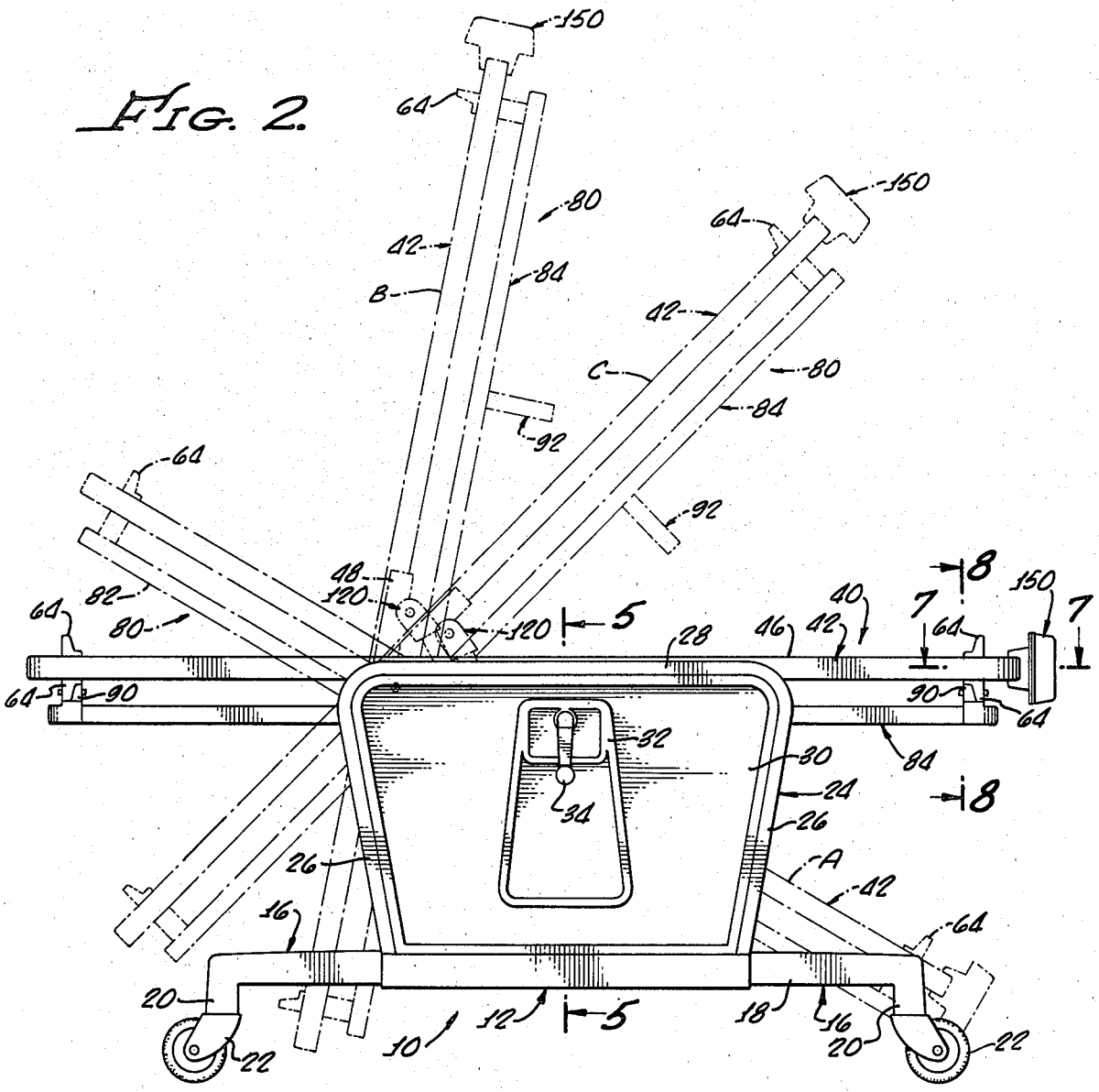
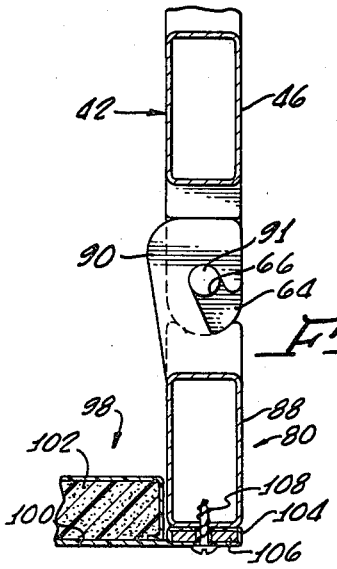
FIG. 8.
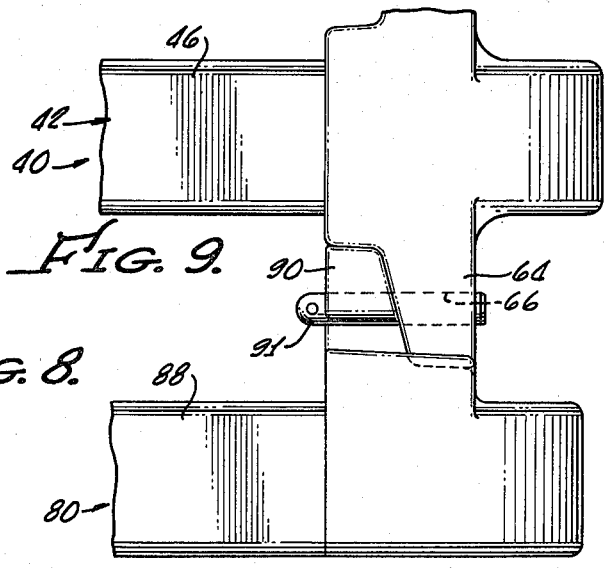
FIG. 9.

MULTIPOSITIONAL MEDICAL BED

BACKGROUND OF THE INVENTION

This invention relates to medical beds having the capability of positioning a patient in various positions.

It has long been desirable to have multipositional beds for use in the care of certain types of medical patients, especially extended care patients. In particular, these types of beds are desirable for any patient requiring a change of position with minimal trauma, as well as for any patient who is unable to change positions by himself. For example, coronary patients, burn patients, patients with spinal cord or other back injuries, orthopedic patients, patients in traction, and patients requiring treatment for shock, as well as intensive care patients in general, often need to have their positions changed at intervals, and often they either cannot or should not do so on their own.

Body position changes may be desirable merely for reasons of convenience, such as to change bed linens; however, they also may be absolutely essential to prevent serious health problems which may occur with extended bed care, such as deterioration of cardiovascular or respiratory or urinary functions, osteoporosis, muscle atrophy, decubitus ulcers, and even static pneumonia. On the other hand, a patient who is turned, or whose position is changed, without special precautions may suffer great trauma, prolonging or even aggravating his medical problems. Burn patients, for example, may have their healing times greatly prolonged and suffer much pain and discomfort due to the necessity for moving or turning them in their beds, and it is not uncommon even to destroy skin grafts during such position changes.

A wide variety of prior art beds have been designed in attempts to overcome some of the problems associated with changing the positions of medical patients. All of them suffer from one or more deficiencies which limit their utility or desirability. Some are composed of complex structures and provide only limited access to the patient from much of the area around the bed. Some are relatively cumbersome, heavy or immobile, or they are not adaptable to being conveyed or lifted by conventional means in most hospitals. Most prior art beds are not easily cleaned, and they often have numerous crevices in which contamination may occur. Those prior art devices which achieve any significant capability for multipositional operation typically have a large number of moving parts and may require a great deal of maintenance. None of the prior art devices provides complete utility for a full range of medical treatments. Many require electric motors or other drive means which are not only subject to malfunction but may produce eddy currents which interfere with sensitive electronic equipment or even induce problems in coronary patients having electric pacemakers.

The more ambitious efforts to overcome the problems of the prior art have resulted in beds of still greater complexity, expense, and susceptibility to malfunctioning, or other problems.

It is an object of the present invention to overcome or greatly alleviate the problems of the prior art medical beds.

BRIEF DESCRIPTION OF THE DRAWINGS

FIG. 2 is a side elevation showing the mattress and associated frame assembly in a variety of positions;

FIG. 8 is a fragmentary cross-sectional view taken along line 8—8 of FIG. 2; and FIG. 9 is a side view of FIG. 8.

SUMMARY OF THE INVENTION

This invention contemplates a medical bed having a mattress or mattresses mounted in a frame that can be rotated about a longitudinal axis and tilted about a transverse axis. The invention may include removable mattresses which are adapted to permit the complete enclosure and immobilization of a patient to permit 360° rotation about the longitudinal axis.

The mattresses may be supported on a tension sheet which is suspended within a rectangular inner frame. The inner frame, in turn, is rotatably mounted at its end by means of axles positioned at its longitudinal axis to permit rotation within a surrounding outer frame. The outer frame may, in turn, be mounted along a transverse axis on axles which are rotatably attached to a supporting platform.

The bed permits tilting from a substantially vertical position to a head-down position, substantially below the horizontal. The bed also has the flexibility of permitting positioning in an infinite variety of orientations, over a wide combination of degrees of tilt and rotation.

DETAILED DESCRIPTION OF THE INVENTION

Figure 1:
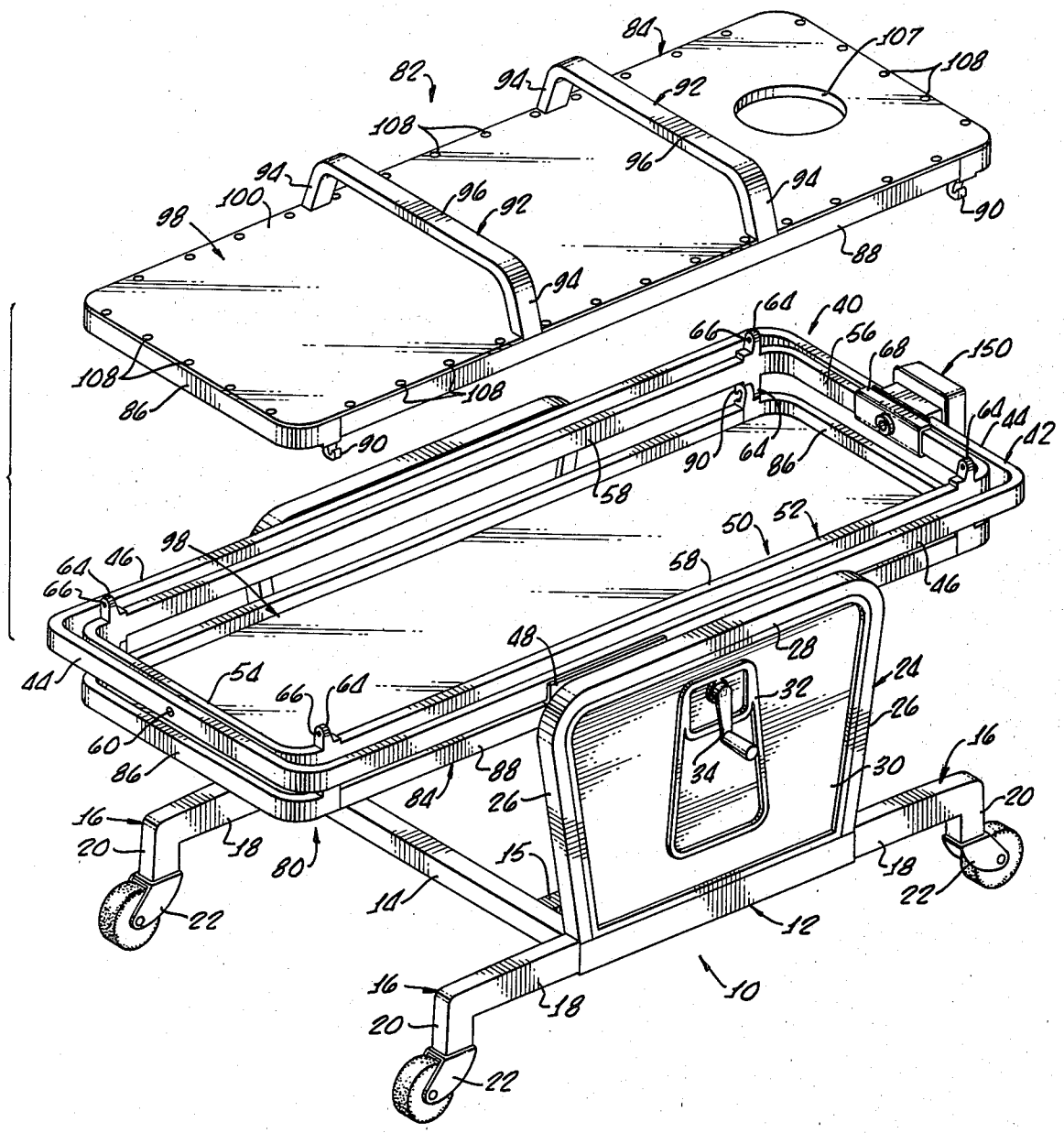
FIG. 1 is an exploded perspective of the multipositional bed showing a mattress support means detached from the bed.

FIG. 1 shows the major external components of the multipositional bed. A platform unit 10 comprised of a base portion 12 having cross beams 14, brace members 15, and legs 16 makes up the lower portion of the bed. The legs 16 are preferably constructed having horizontal members 18 and vertical members 20 mounted on casters 22. The horizontal members 18 and vertical members 20 may be made of separate elements joined, for example, by welding, or they may be prepared by bending or forming unitary elements. In a preferred embodiment, the horizontal members have about an 8" floor clearance to correspond to standard hospital Surgilift clearance.

Rigidly attached to the base portion of the platform unit 10 are side walls 24, which include vertical strut members 26 and longitudinal members 28. These vertical strut members and longitudinal members may also be formed of a unitary construction or they may be constructed by welding or otherwise attaching separate vertical members to longitudinal members.

The outer side of the side walls are covered by decorative covers 30 having ornamentation 32. As will be seen hereinafter, the decorative covers serve to cover the tilt-drive mechanism for tilting the bed through the various positions shown in FIG. 2. (Crank 34, shown in FIGS. 1 and 2, is detachably connected to the tilt-drive mechanism located behind the decorative cover 30.)

The platform unit supports an outer frame unit 40, which includes a generally rectangular pivotal or tilting frame 42 comprised of transverse members 44 and longitudinal members 46. A pivot casting 48 is secured to the longitudinal member 46 at each side of the bed and is used to support the outer frame unit 40 and to tilt the unit relative to the platform unit 10, as will be described hereinafter.

An inner frame unit 50 (shown partially rotated in FIG. 4) is rotatably supported within the pivotal or tilting frame 42. The inner frame unit 50 includes a rotating or gimbal frame 52, which is generally rectangular in shape and includes a transverse member 54 at the foot end of the bed and a transverse member 56 at the head end unitarily connected to longitudinal members 58 at each side of the gimbal frame.

The gimbal frame 52 is rotatably mounted by means of a shaft or axle 60 at the foot end of the bed and a similar shaft or axle 62 at the head end mounted on the center line of the gimbal frame 52. The clearance between both the transverse members and the longitudinal members of the gimbal frame and the pivotal frame is sufficient to virtually insure that the hands or fingers of a patient will not be pinched between the adjacent members during rotation of the gimbal frame. The principal structural components of the platform unit, as well as the inner and outer frame units, are preferably of closed tubular steel, welded to reduce the potential for contamination of crevices, fittings, and the like.

Four lugs 64 extend upwardly and four identical lugs extend downwardly from the gimbal frame 52, an opposed pair of lugs being positioned at each corner of the frame, as shown in FIGS. 1 and 2. Each lug includes a longitudinally bored journal 66, which is used for pinning and securing the mattress units to the gimbal frame, as described hereinafter.

Figure 7:
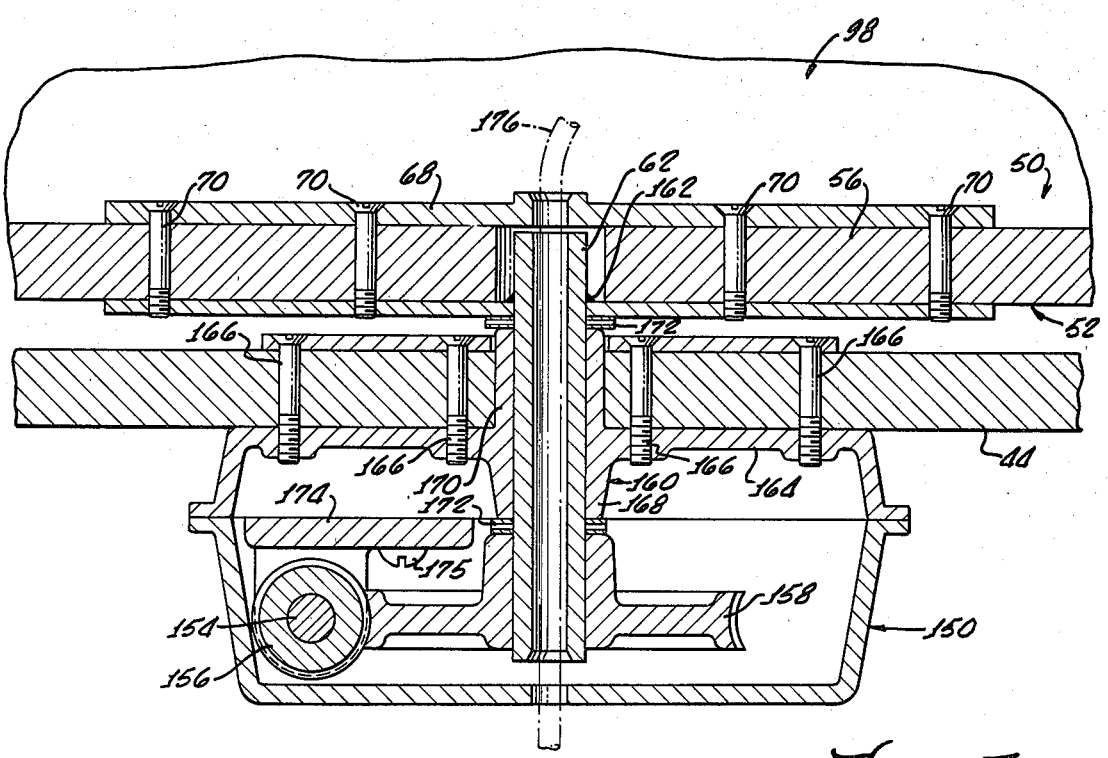
FIG. 7 is an enlarged cross-sectional view taken along line 7—7 of FIG. 2.

A casting or clamp 68 is rigidly attached, as by welding, to the axle 62 at the head end of the gimbal frame, for mounting the axle on transverse member 56. FIG. 7 shows the casting or clamp 68 secured to transverse member 56 by means of a series of machine screws 70, so that rotation of the axle 62 will produce a concurrent rotation of the gimbal frame.

FIG. 1 shows the multipositional bed with a pair of mattress units, a lower mattress unit 80 secured to the lugs 64 beneath the gimbal frame and an upper mattress unit 82 in exploded perspective above the gimbal unit. The lower and upper mattress units may be identical in structure, and each includes a generally rectangular mattress frame 84 having transverse end members 86 and longitudinal side members 88. Each of the longitudinal side members 88 includes a connecting lug 90 extending vertically near each end to next with the corresponding lugs 64 of the gimbal frame. FIGS. 8 and 9 show an enlarged portion of the gimbal frame, showing the longitudinal member 58 of the gimbal frame and a lug 64 nested with and connected to lug 90 on the longitudinal side member 88 of the mattress frame 84. The lug 64 and lug 90 are shaped to nest together such that their journalled interiors line up and are pinned together with pin 91.

FIG. 1 also shows the cross-bracing members 92 on the upper mattress unit 82. Each cross-bracing member includes vertical legs 94 and a horizontal portion 96 which may be formed in a unitary construction or may consist of separate elements welded or otherwise securely fixed together.

Figure 5:
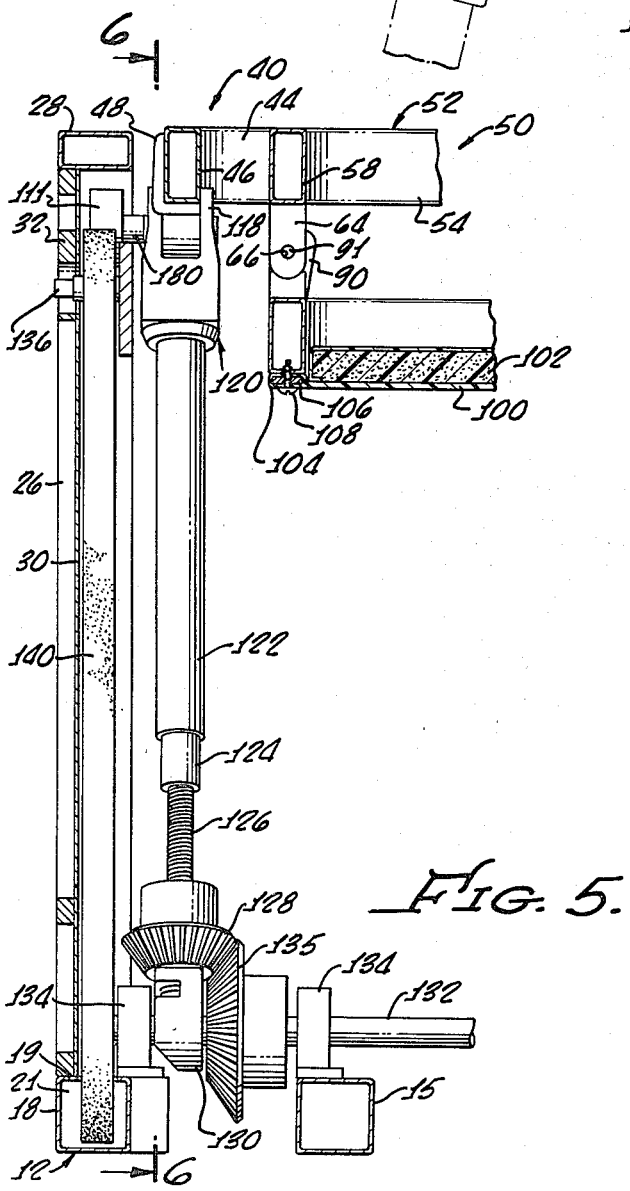
FIG. 5 is an enlarged cross-sectional view taken along line 5—5 of FIG. 2.

Each mattress unit also includes a support unit 98, which is comprised of a flexible tension sheet or support member 100, such as a vinyl plastic, and a foam cushion element 102 (see FIGS. 5 and 8). The flexible mattress support member 100 is equipped with a tubular portion 104 around its periphery. A strengthening member 106, which may consist of a thin steel strip, extends the full length of the flexible mattress support 100 and also extends transversely across both ends of the support through the tubular portion 104. Screws 108 may be used to secure the support unit 98 to the rectangular mattress frame 84, as shown in FIGS. 1, 5, and 8, by sandwiching the strengthening member 106 within tubular portion 104 and the frame members.

FIG. 2 shows the bed with the lower mattress attached. The normal horizontal position of both the gimbal frame and the tilting frame are shown in solid lines. Also shown in broken lines "A" is the head-down or "Trendelenberg" position with the head end of the bed approximately at a 28° angle below the horizontal. A step on/step off position is shown in broken lines "B", in which the gimbal frame is maintained parallel to the tilting frame, but the tilting frame is raised to a position of about 86° from the horizontal. In this position, by using a clamp-on plate (not shown) to stand on at the foot of the bed a standing patient can easily be positioned against the bed without bending and then the bed can be lowered into normal resting position.

An intermediate position is shown in broken lines "C" in which the head end of the bed is raised to approximately 45° from the horizontal. This position may be used for various medical treatments and is also particularly desirable for use when a patient is to be rotated from a supine position to a prone position.

Figure 4:
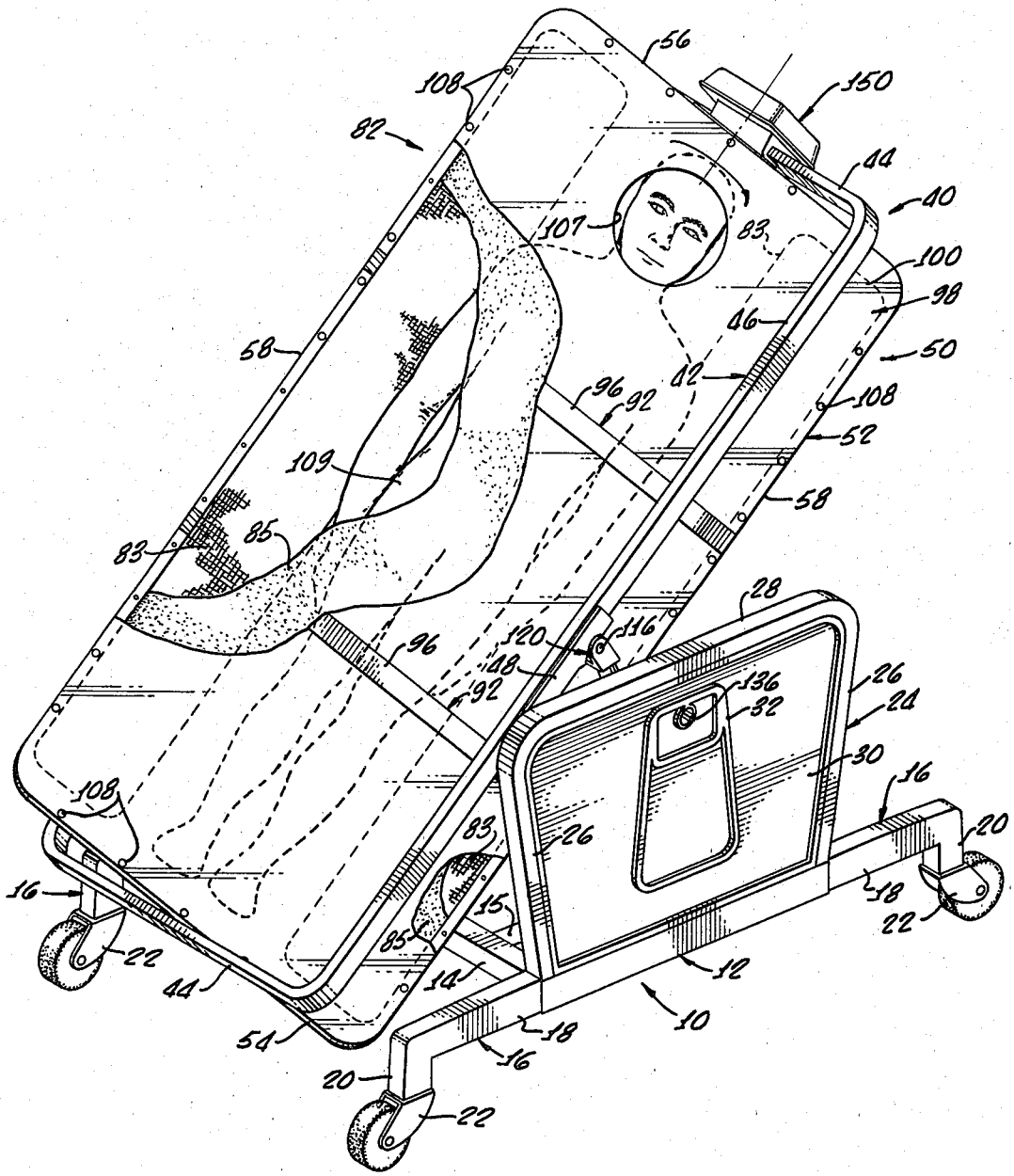
FIG. 4 is a partially cutaway perspective view, showing the mattress frame tilted relative to its transverse axis and partially rotated relative to its longitudinal axis.

The method of rotating a patient from a supine position (face up) to a prone position (face down) is best illustrated by reference to FIGS. 1, 2 and 4. With the patient 109 positioned on his back in the bed in normal horizontal position, as shown in FIG. 1, elongated cushions or bolsters 83, rectangular in cross-section, are positioned along each side of the patient, as shown in FIG. 4, to brace the patient against sideways slippage. Then an air mattress or pad 85, in deflated form, is placed over the patient. An upper mattress unit is then positioned on top of the patient, and the connecting lugs 90 are engaged with the lugs 64 on the upper side of the gimbal frame, as previously discussed. The air pad 85 is then inflated sufficiently to immobilize the patient. The patient (and the bolsters) are thus sandwiched firmly between the lower mattress unit and the air pad and upper mattress unit. This prevents the patient from shifting position during the tilting or rotation of the bed. The upper mattress unit and air pad preferably have an opening 107 to permit the patient's face from being covered.

With the patient thus sandwiched securely in position, the tilting frame is tilted to elevate the head to approximately a 45° position, as shown in broken lines "C" in FIG. 2, and then the inner frame unit 50, as shown in FIG. 4, is rotated 180° so that the patient is face down with the original lower mattress unit becoming the upper mattress unit and vice versa. The tilting frame unit can then be lowered back to a horizontal position, after which the air pad can be deflated (and removed if desired) and the mattress unit above the patient can be removed leaving the patient facing downwardly on the lower mattress unit. Thus, the patient can be completely rotated in position without any physical movement or distortion at all on his part.

It is particularly important that the patient be lifted to approximately a 45° tilt position before the gimbal frame is rotated. This prevents the patient from having undue side slipping stresses, when the gimbal frame is perpendicular to the tilting frame, as would occur if the tilting frame were left in a horizontal position throughout the movement. On the other hand, it is important not to raise the tilting frame excessively above 45°, since an excessive tendency to slip toward the foot of the bed may occur. These precautions are particularly important where substantially complete immobilization of the patient is desired, as, for example, in the case of burn patients recovering from skin grafts which are located in positions in contact with the mattresses.

Figure 3:
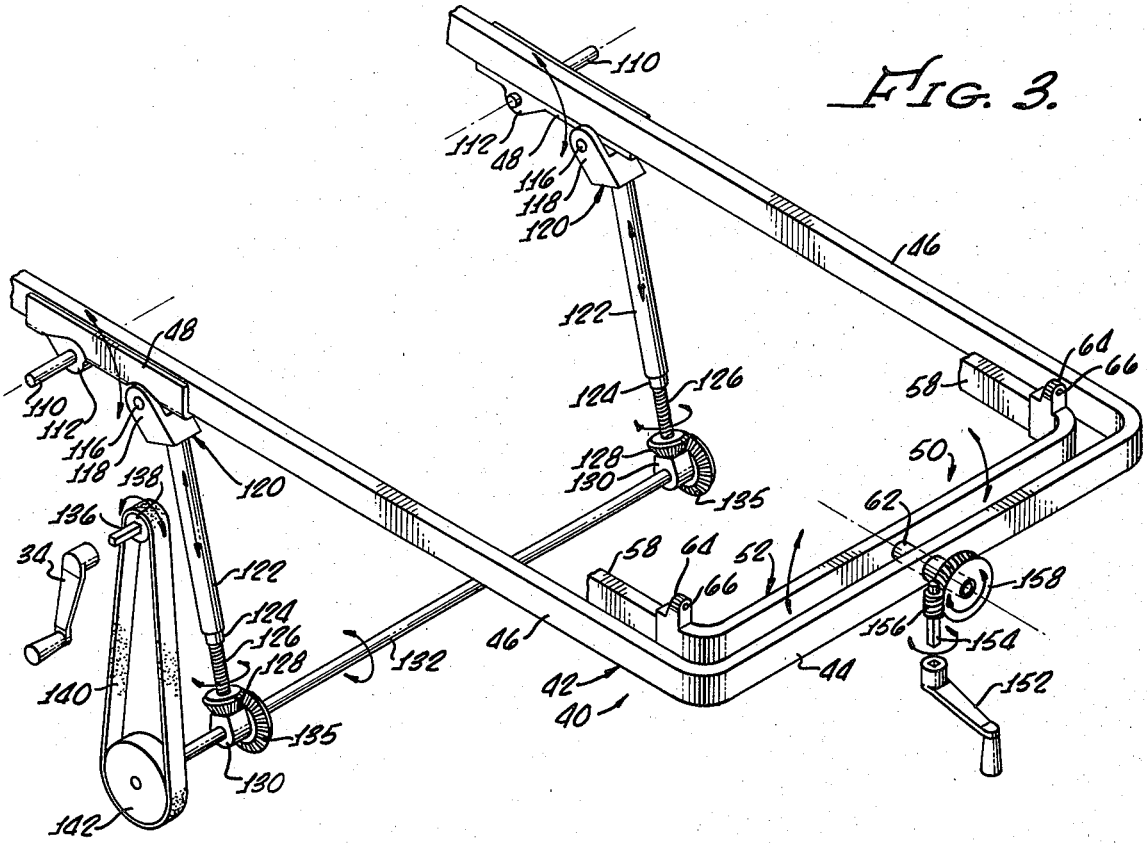
FIG. 3 is a fragmentary perspective view from the head of the bed showing the drive mechanisms for rotating and tilting the frame.

FIG. 3 shows the mechanisms which are employed to tilt the pivotal or tilting frame and to rotate the gimbal frame. The tilt frame drive mechanism includes a pair of transverse axles 110, which are engaged in openings in downwardly extending lugs 112 of the pivot castings 48 which cradle the longitudinal members 46 of the pivotal or tilting frame. The transverse axles 110 are supported by and rotate within conventional bearing or journal means 111 (see FIG. 5) which are secured to the side walls of the platform unit of the bed.

Each pivot casting 48 also includes a second lug descending downwardly and displaced from lug 112 toward the head end of the bed. The second lug 114 (see FIG. 6) is journalled to receive pin 116, which engages the journalled prongs 118 of clevis 120. The clevis 120 is secured to a lead screw drive means. The drive means consists of a hollow tube 122, affixed at its upper end to the clevis 120, a lead screw nut 124, affixed within the lower end of the hollow tube, and a lead screw 126, which threadedly engages and extends through nut 124.

The lead screw 126 is affixed at its lower end to a pinion bevel gear 128, which is rotatably mounted on, and is supported by, a bearing means 130, which includes conventional thrust bearings (not shown) to stabilize and support pinion bevel gear 128 and radial bearings (not shown) about transverse drive shaft 132 to permit the drive shaft to rotate within bearing means 130. The drive shaft 132 is also affixed to bevel ring gear 135, which engages pinion bevel gear 128.

The transverse drive shaft 132 extends through, and is mounted within, conventional journals or bearings 134 mounted on horizontal member 18 and brace member 15, as shown in FIG. 5.

Referring specifically to FIGS. 3 and 5, it can be seen that by engaging crank 34 with pulley drive shaft 136, the primary pulley 138 can be rotated, thus driving the drive belt 140 which, in turn, rotates secondary pulley 142. Pulley 142 extends downwardly through an opening in the upper wall 19 of member 18, fitting partially within the hollow interior 21 thereof. The secondary pulley is affixed to transverse drive shaft 132 and, thus, rotates bevel ring gear 135 to drive pinion bevel gear 128, thus rotating lead screw 126 within nut 124 of the lead screw drive means.

As the lead screw 126 threadedly moves through nut 124, it extends into or retracts from hollow tube 122, depending on the direction of rotation. When the lead screw 126 extends further into hollow tube 122, the tube is drawn downwardly pulling clevis 120 downwardly, and this, in turn, causes the head end of the bed to tilt downwardly, the tilting frame rotating about axles 110. Conversely, when the lead screw 126 is rotated to retract from nut 124, the hollow tube 122 and clevis 120 are forced upwardly, thus lifting the head end of the tilting frame.

As the mechanism is illustrated in FIG. 3, a clockwise rotation of crank 34 produces an elevation of the head end of the bed, and a counterclockwise rotation causes the head end of the bed to tilt downwardly.

Figure 6:
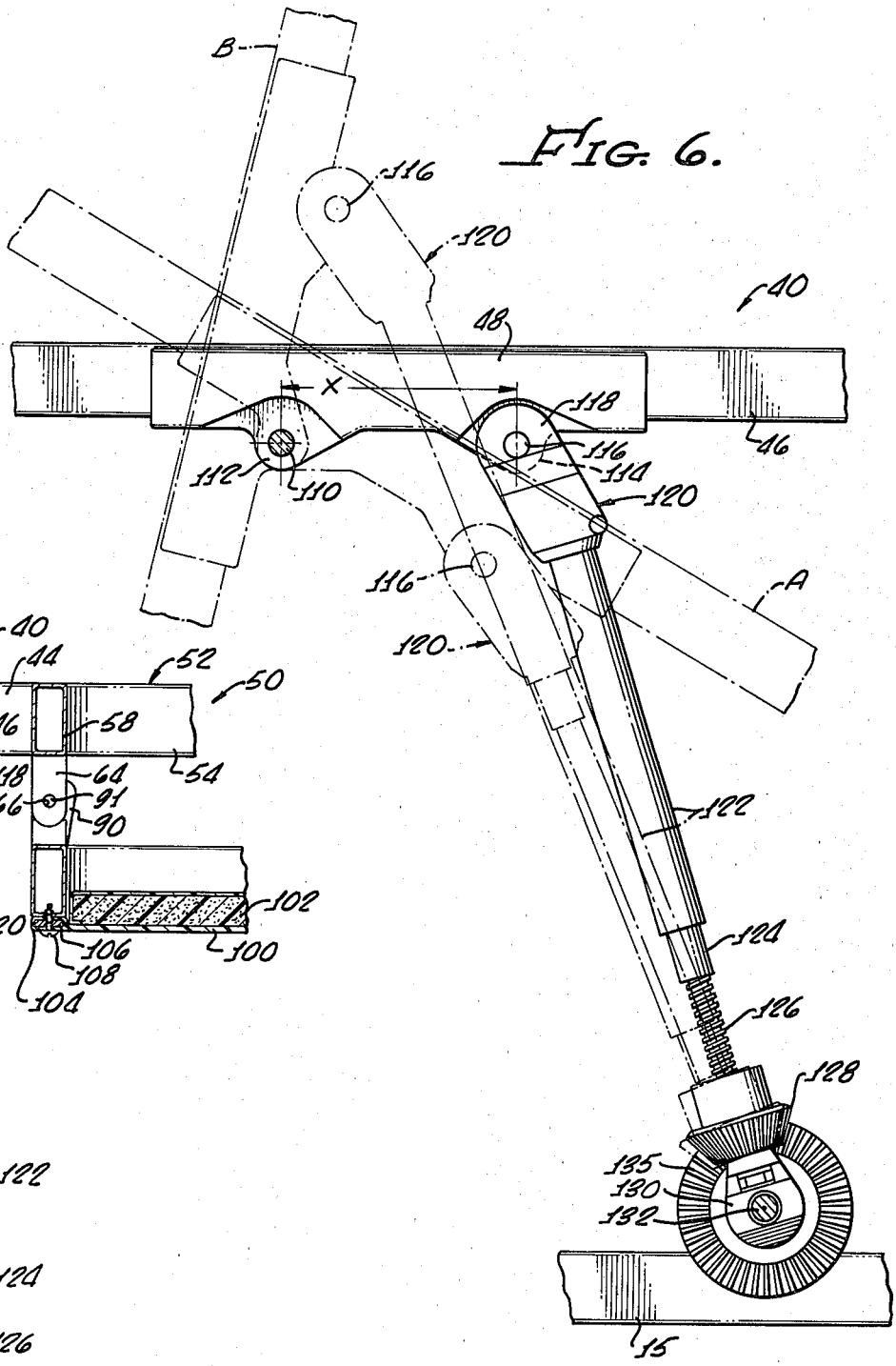
FIG. 6 is a cross-sectional view taken along line 6—6 of FIG. 5 and showing the tilting mechanism in various positions.

FIG. 6 shows part of the tilt drive mechanism with the normal horizontal bed position depicted in solid lines, and the extreme head down position depicted in broken lines "A", and the step on/step off position depicted in broken lines "B".

While some variation is permissible, it has been found that for a normal size bed 88 inches in length and 34 inches high, the distance "X" between the axes of the transverse axles 110 of the tilting frame drive mechanism and the pins 116 securing the clevis 120 to the pivot casting 48 should be within the range from about 5 to about 8 inches and, preferably, in the range from about 6 to about 7 inches. If unduly short spacing between these pivot axes is used, the bed will lack necessary stability and also will impose undue stresses on the members of the drive mechanism or require much lower gear ratios to unduly lengthen the time required to tilt the bed. Also, if unduly long distances between the pivot axes are employed, it becomes impractical, with conventional lead screws, to move the bed through the full range of positions desired. The precise location of the axes along the length of the tilting frame depends on the length of frame used, and the transverse axles 110 must, in any event, be closer to the foot of the bed than the head, to enable the frame to tilt to a step on/step off position.

The rotating drive mechanism for rotating the gimbal frame within the tilting frame is enclosed in a protective and decorative housing 150, as shown in FIGS. 1, 2 and 4.

The details of the mechanism are illustrated in FIGS. 3 and 7. Therein is shown a crank 152, which may be detachably engaged with shaft 154 to rotate worm gear 156. The movement of the worm gear imparts rotation to driven gear 158, which is affixed to the shaft or axle 62, which extends through bearing means 160 and is affixed to the transverse member 56 at the head of the gimbal frame, as by welds 162 and bracket 68.

Bearing means 160 includes a bracket or casting 164 which may be mounted on transverse member 44 of the pivotal or tilting frame by means of screws 166. The bracket or casting 164 includes bosses 168 and 170 on either side of the casting and bearings or washers 172 to permit ready rotation of shaft 62 and the gimbal frame. The worm gear can be mounted relative to the driven gear 158 in any conventional manner. For illustrative purposes, it is shown in FIG. 7 as being mounted by means of bracket 174 which is secured to casting 164 with screw 175.

A particularly desirable feature of the invention permits removal of the cranks 34 and 152, so that, due to the lead screw and worm gear types of drive mechanisms, the gimbal frame and the tilting frame are both essentially locked in position. No normally encountered forces exerted, e.g., by heavy or violently moving patients, against the frames will cause any noticeable change of position.

A particular desirable feature which may be employed with the invention includes the use of a hollow tube for axle 62 to permit a multi-lead cable (shown in dotted lines 176) to extend all the way through the tube. The multi-lead cable can be used for telemetry or electrical monitoring devices attached to the patient and, thus, can be rotated with the patient without tangling the multiple leads and without the necessity for interrupting readings while the gimbal frame is rotated.

Many other uses and variations of the invention will be apparent to those skilled in the art, and while specific embodiments of this invention have been described, these are intended for illustrative purposes only. It is intended that the scope of the invention be limited only by the attached claims.

What is claimed is:

1. A multipositional medical bed adapted for changing a patient's position in said bed comprising:

a platform, an elongated outer frame, means for pivotally mounting said outer frame on said platform, an inner frame, means for rotatably mounting said inner frame along its longitudinal axis within said outer frame, a lower mattress, means for mounting said lower mattress on said inner frame to support said patient thereon, an upper mattress, means for mounting said upper mattress to cover said patient, means for tilting said outer frame from a horizontal position to a position at least about 45° above horizontal at the head end, and means for rotating said inner frame 180° while said outer frame is tilted above horizontal.

2. A bed as recited in claim 1 wherein the one of said upper mattress and lower mattress which is against the front of said patient is provided with an opening therethrough to expose said patient's face.

* * * * *